United States Patent [19]

Christianson

[11] Patent Number: 4,643,377

[45] Date of Patent: Feb. 17, 1987

[54] MECHANICALLY EXPANDING CLIMBING AID

[76] Inventor: Tony Christianson, 277 Grulla Ct., Norco, Calif. 91760

[21] Appl. No.: 780,375

[22] Filed: Sep. 26, 1985

[51] Int. Cl.[4] ..... A47G 29/00

[52] U.S. Cl. ..... 248/1

[58] Field of Search ..... 248/1; 411/340–346

[56] References Cited

U.S. PATENT DOCUMENTS

| | | | |
|---|---|---|---|
| 977,795 | 12/1910 | Gronke | 411/344 |
| 1,035,419 | 8/1912 | Clark | 411/344 |
| 1,199,297 | 9/1916 | Obeda | 411/344 |
| 2,682,190 | 6/1954 | Snyder | 411/346 |
| 3,534,650 | 10/1970 | Kubokawa | 411/344 |
| 3,877,679 | 4/1975 | Lowe . | |
| 3,946,975 | 3/1976 | Lyman, Jr. | 248/1 |
| 3,948,485 | 4/1976 | Chouinard | 248/1 |
| 4,069,991 | 1/1978 | Saunders | 248/1 |
| 4,082,241 | 4/1978 | Burkey | 248/1 |
| 4,184,657 | 1/1980 | Jardine . | |
| 4,422,607 | 12/1983 | Vallance | 248/1 |
| 4,476,088 | 10/1984 | Barnes | 411/341 |
| 4,491,291 | 1/1985 | Ching | 248/1 |

FOREIGN PATENT DOCUMENTS

| | | | |
|---|---|---|---|
| 47232 | 3/1982 | European Pat. Off. | 248/1 |
| 336140 | 10/1904 | France | 411/341 |
| 38137 | 1/1915 | Sweden | 411/342 |

*Primary Examiner*—J. Franklin Foss
*Assistant Examiner*—Robert A. Olson
*Attorney, Agent, or Firm*—G. Donald Weber, Jr.

[57] ABSTRACT

The present invention is an improved climbing aid which includes one or more pair of opposing cam members, two parallel axles on which the opposing cam members pivot separately with crossed radii, axle joining members situated between the opposing cam members, a looped cable member connected to the axle joining members which provides the means for attachment of a climbing rope, spring members which act to simultaneously move the cam members toward their fully expanded positions, and an operating member which is connected to each cam member such that when it is pulled the cam members retract in order to allow insertion or removal of the improved climbing aid into or out of a crack in rock.

11 Claims, 6 Drawing Figures

MECHANICALLY EXPANDING CLIMBING AID

BACKGROUND OF THE INVENTION

1. Field of the Invention

The present invention is related to climbing aids and more particularly to mechanically expanding climbing aids which lockingly engage cracks in rock and function as a firm and secure anchor in order to protect climbers by either preventing or arresting a fall.

2. Description of the Prior Art

Climbers typically utilize rope along with a variety of mechanical devices which aid and protect their movement over a rock face. Some of the climbing aids serve as a means to firmly anchor the rope, and thereby the climber, to the rock for the purpose of either preventing or arresting a fall.

A firm and secure anchor can sometimes be accomplished by wedging a climbing aid of fixed shape into a crack in the rock. Such fixed shape climbing aids are known in the climbing community as chocks or chockstones or nuts. They are available in a variety of shapes and sizes in order to accommodate variations in the shape and size of the cracks which a climber may encounter.

U.S. Pat. No. 4,082,241, entitled Chock for Mountain Climbing, issued to John Brent Burkey on Apr. 4, 1978, teaches a chock for mountain climbing which is in the form of a truncated pyramid. U.S. Pat. No. 3,948,485, entitled Irregular, Polygonal Mountaineering Chock, issued to Yvon Chouinard and Thomas M. Frost on Apr. 6, 1976, teaches a polygonal chock. U.S. Pat. No. 4,069,991, entitled Chock for Rock Climbing, issued to Thomas C. Saunders and James R. Clark on Jan. 24, 1978, teaches a chock for use with a loop sling. U.S. Pat. No. 3,946,975 entitled Climber's Chockstone, issued to Thomas G. Lyman, Jr. on Mar. 30, 1976, teaches a chock which is formed of a polycarbonate resin defining a body having three different sized pairs of opposed faces. U.S. Pat. No. 4,422,607, entitled Climbing Chocks, issued to Mark Vallance on Dec. 27, 1983, teaches a chock having a generally wedge shaped body with two opposite side faces of which are respectively of concave and convex configuration.

Climbing aids of a fixed shape and size are not very effective in wide, smooth, parallel sided or openly flaring cracks. For such applications, mechanically expanding climbing aids have been developed. U.S. Pat. No. 3,877,679 entitled Anchor Device for Mountain Climbers, issued to Greg E. Lowe on Apr. 15, 1975, teaches a climbing aid which includes a main body and an orientation assembly. The orientation assembly is pivotally mounted on the main body and provides the means for attachment of the climber's rope. The main body is provided with opposed pairs of tapered sides forming wedges for fixed size placement in cracks. In addition, the main body has an arcuate cam surface which is configured to spiral outward with a constant surface intercepting angle as it rotates about the orientation assembly pivot point.

U.S. Pat. No. 4,184,657, entitled Climbing Aids, issued to Raymond D. Jardine on Jan. 22, 1980, teaches a climbing aid which includes a support bar, a single spindle which is mounted on the support bar, two pairs of cam members which are pivotally mounted on the spindle and which are adapted for opposite pivotal movement from a "closed" position to an "open" position, and spring members which are mounted on the spindle between each pair of cam members and which act to apply force to each cam member in order to urge them into their "open" positions. The climbing aid also includes an operating bar which is slidably mounted on the support bar and which is connected to each cam member. A climbing rope attachment point is located on the support bar at the end opposite the spindle. A downward force on the operating bar pulls the cam members into their "closed" positions so that the climbing aid can be inserted into a crack. The operating bar is then released and the spring members force the cam members toward their "open" positions in order to hold the climbing aid within the crack. The cam members are shaped such that movement progressively spirals the cam surfaces outward thereby jamming the climbing aid within the crack.

U.S. Pat. No. 4,491,291, entitled Climbing Aid for Mountain Climbers, issued to Paul W. Ching on Jan. 1, 1985, teaches a climbing aid which includes a pair of laterally extending plates and a load bearing member. The plates frictionally engage facing surfaces of a crack in order to preclude withdrawal from the crevice of the supported load bearing member. The climbing aid also includes a release which is located on the load bearing member and which, on actuation, retracts the plates in order to accommodate withdrawal of the climbing aid from within the crack.

The mechanically expanding climbing aids of U.S. Pat. No. 3,877,679, U.S. Pat No. 4,184,657 and U.S. Pat. No. 4,491,291 have several shortcomings which limit their reliability and consequently their usefullness. High jamming forces, which are generated when a load is applied, are directed to and concentrated at the ends of a single, relatively long shaft, which can lead to structural failure due to bending. Spaced, staggered mounting of opposing cam members on a common shaft produce high bending couples, which also can lead to structural failure. Pivoting cam members on a common shaft necessitates a relatively tight cam surface curvature which concentrates frictional forces over a small contact area, which causes rapid cam surface wear. Some loading situations force the application of side loads which act to bend and break the rigid components of the climbing aid, thereby leading to potentially catastrophic failure. Also, although the climbing aid expanding members typically swing through a 90° arc from the fully retracted to the fully expanded positions, only the central 45° arc of movement is practical for use, thereby requiring a relatively large number of climbing aid sizes in order to accommodate the full range of crack widths which a climber encounters while climbing.

SUMMARY OF THE INVENTION

In view of the foregoing factors and conditions which are characteristic of the prior art, it is the primary object of the present invention to provide an improved climbing aid which mechanically expands to lockingly engage cracks in rock, or the like, and reliably functions as a firm and secure anchor in order to protect climbers by either preventing or arresting a fall.

It is another objective of the present invention to provide an improved climbing device in which the operating forces are evenly distributed over several closely supported bearing surfaces.

It is still another objective of the present invention to provide an improved climbing aid in which the area of contact with the crack walls is relatively large.

It is yet another objective of the present invention to provide an improved climbing device in which the rope attachment member retains its strength even when it is bent or twisted.

It is still yet another objective of the present invention to provide an improved climbing aid which minimizes the number of sizes needed in order to accommodate the full range of crack widths which a climber encounters while climbing.

In accordance with an embodiment of the present invention, an improved climbing aid is described. The improved climbing aid includes one or more pair of opposing cam members, two parallel axles on which the opposing cam members pivot separately with crossed radii, axle joining members situated between the opposing cam members, a looped cable member connected to the axle joining members which provides the means for attachment of a climbing rope, spring members which act to simultaneously move the cam members toward their fully expanded positions, and an operating member which is connected to each cam member such that when it is pulled the cam members retract in order to allow insertion or removal of the improved climbing aid into or out of a crack in rock.

The features of the present invention which are believed to be novel are set forth with particularity in the appended claims.

Other claims and any of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENT

In order to best understand the present invention, it is necessary to refer to the following description of its preferred embodiment in conjunction with the accompanying drawings.

Figure 1:
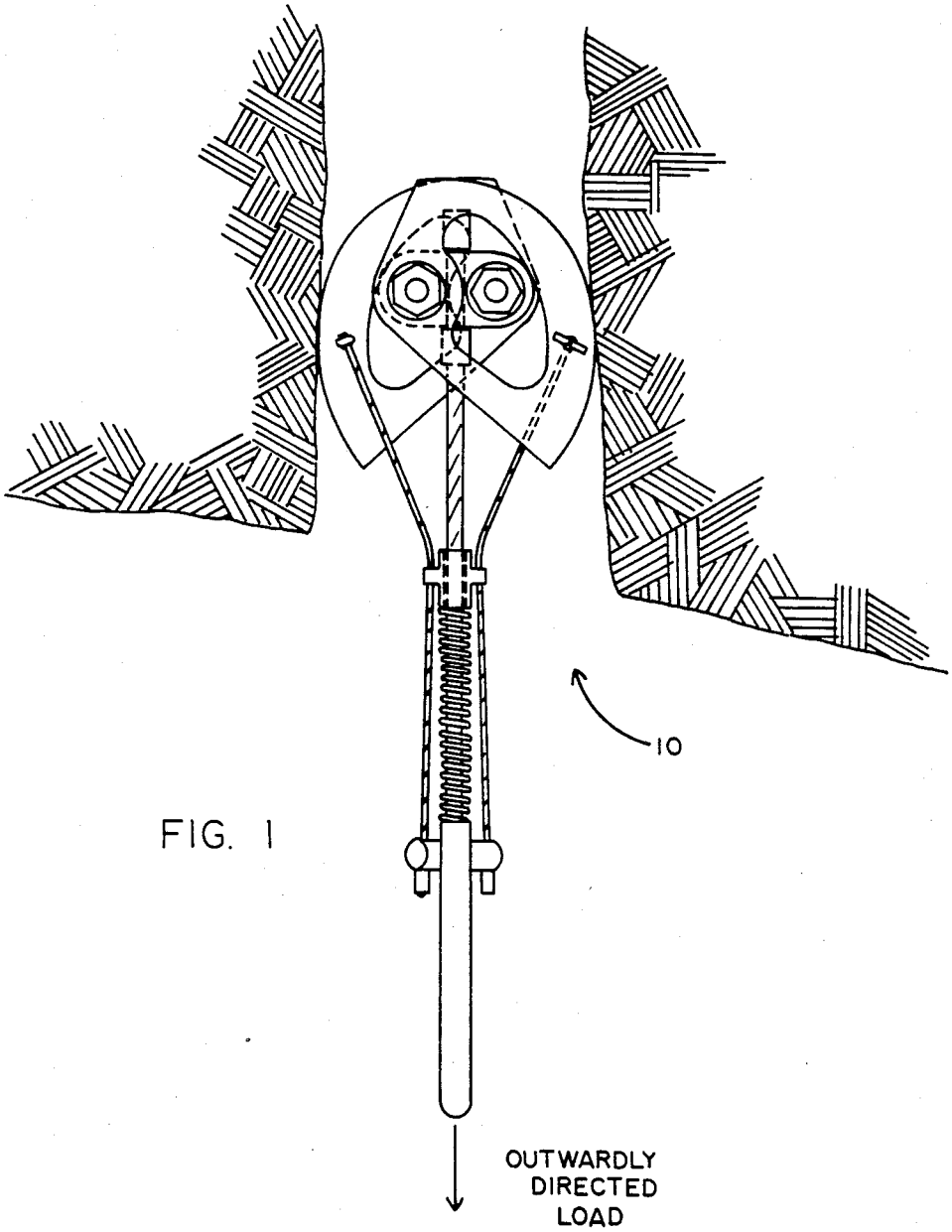
FIG. 1 is a front elevational view of an improved climbing aid which has been constructed in accordance with the principles of the present invention and which is inserted in a crack in rock, or the like, and firmly anchored by an outwardly directed load.

Referring to FIG. 1, an improved climbing aid 10 is inserted in and firmly anchored by an outwardly directed load to the generally parallel walls of a crack in rock, or the like. The cam members are shown partially retracted as a result of the spacing of the crack walls.

Figure 2:
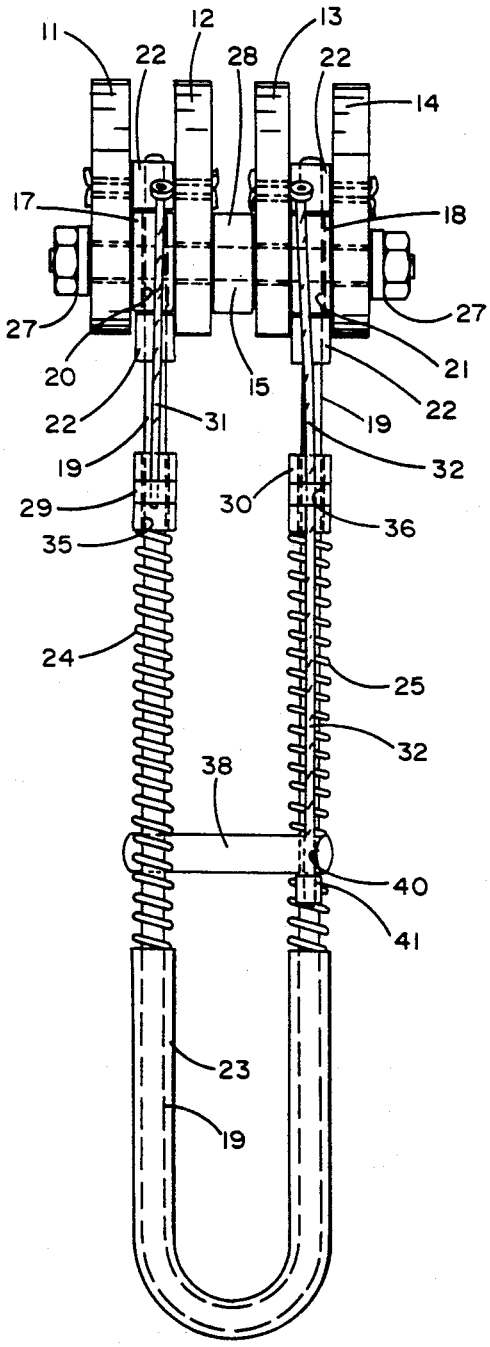
FIG. 2 is a side elevational view of the climbing aid of FIG. 1.
Figure 3:
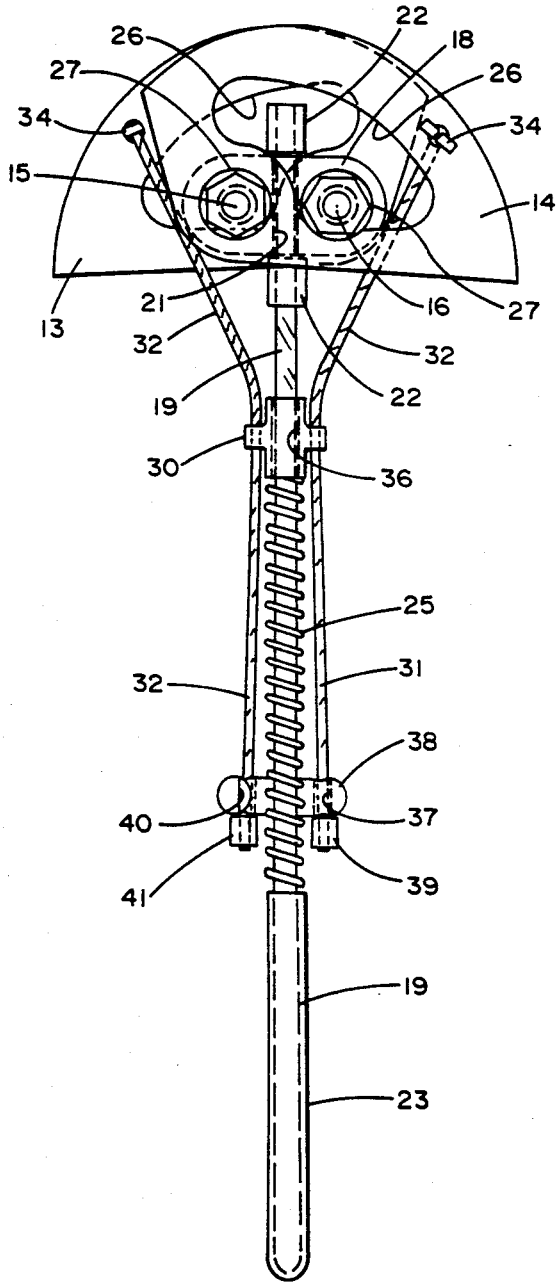
FIG. 3 is a rear elevational view of the climbing aid of FIG. 1.

Referring to FIGS. 2, 3 amd 4, improved climbing aid 10 includes a first pair of opposing cam members 11 and 12, and a second pair of opposing cam members 13 and 14. Cam members 11 and 14 pivot about a first axle 15. Cam members 12 and 13 pivot about a second axle 16. First and second axles 15 and 16 are held parallel by a first joining member 17 and a second joining member 18. First joining member 17 is situated between the first pair of opposing cam members 11 and 12. Similarly, second joining member 18 is situated between the second pair of opposing cam members 13 and 14.

One end of cable 19 passes with loose fit through first hole 20 centrally located in first joining member 17. The other end of cable 19 passes with loose fit through second hole 21 centrally located in second joining member 18. Both ends of cable 19 are held at their respective locations by swaged stop sleeves 22.

Cable 19 passes through tubing 23 which are bent together in order to form a U-shaped member which has legs of equal length. The curved portion of the U-shaped member is the location where the climber attaches a climbing rope. Cable 19 is a high strength wire rope which is capable of sustaining repeated tension, bending and flexural loads, as exemplified in FIG. 5, without a reduction in strength. Tubing 23 serves both to maintain the U-shape of cable 19 after bending and to provide a smooth surface for attachment of the climbing rope.

A first compression spring 24 and a second compression spring 25 are guided by cable 19. First and second springs 24 and 25 act to simultaneously move cam members 11, 12, 13 and 14 toward their fully expanded positions. The arcuate outer surfaces of cam members 11, 12, 13 and 14 are configured to spiral progressively outward as they pivot about their respective axles 15 and 16 until contact is made with the crack walls. First and second springs 24 and 25 also act to maintain frictional engagement of cam members 11, 12, 13 and 14 with the crack walls until an outwardly directed load is applied at the climbing rope attachment point. Because of the frictional engagement with the crack walls, any outwardly directed load will tend to force cam members 11, 12, 13 and 14 even more toward their fully expanded positions thereby jamming and locking improved climbing aid 10 within the crack. Without a load applied, and when cam members 11, 12, 13 and 14 are retracted, improved climbing aid 10 can be easily either inserted in or removed from the crack.

Figure 4:
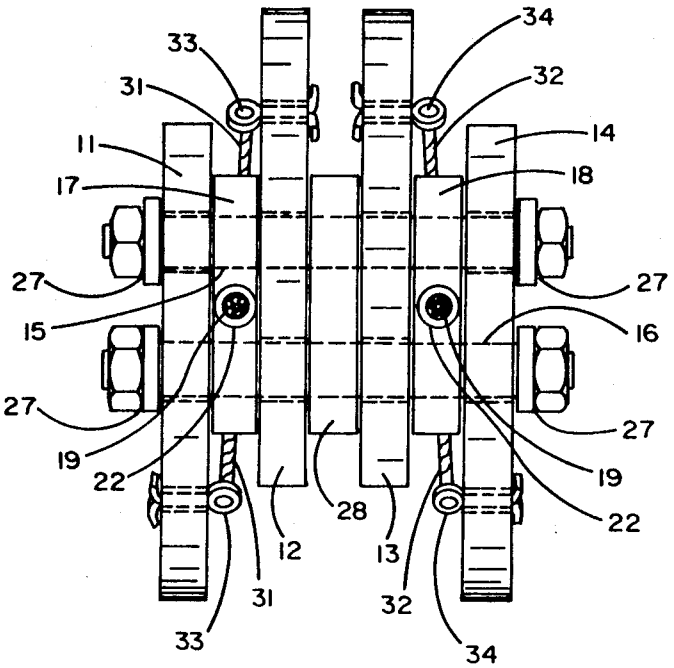
FIG. 4 is a top view of the climbing aid of FIG. 1.

Referring to FIG. 3 and FIG. 4, opposing cam members 11 and 12, and opposing cam members 13 and 14, do not pivot about a common axis but rather pivot with crossed radii about separate, parallel axis. As a result of this structure, the cam members closely intermingle when retracted thereby significantly increasing the useful range of cam members movement from fully retracted to fully expanded. Consequently, the number of improved climbing aid 10 sizes which is needed in order to accommodate the range of crack widths which a climber encounters while climbing is reduced. Because the cam member pivoting radii of improved climbing aid 10 are crossed and subsequently longer than radii of an equivalently sized single axis climbing aid, locking leverage and resulting anchoring force are significantly greater. Similarly, because the cam member arcuate outer surface curvature of improved climbing aid 10 is broader than that of an equivalently sized single axis climbing aid, the contact area with the crack walls is increased thereby reducing cam member outer surface wear. Also, because first and second joining members 17 and 18 support first and second axles 15 and 16 between first and second pair of cam members 11 and 12, and 13 and 14, respectively, with a minimum of axle overhang, and because bearing loads are shared equally by two axles instead of a single spindle, this structure avoids structural failure due to high bending forces and couples.

Referring to FIG. 3, each cam member includes an open central cut-out 26. Cut-out 26 is shaped to enable the cam member to pivot approximately 90° about its axle without interference from the adjacent second axle. Cut-out 26 is also shaped to limit the range of angular movement of the cam member by providing limit stops which act against the adjacent axle. Cut-out 26 also serves to reduce the material weight of the cam member.

Referring to FIG. 4, first and second axles 15 and 16 are equal length and are threaded at each end to receive washer and nut sets 27. A spacer 28 maintains the separation of adjacent cam members 12 and 13. First joining member 17 maintains the separation of adjacent cam members 11 and 12. Second joining member 18 maintains the separation of adjacent cam members 13 and 14. Washer and nut sets 27 serve to prevent the cam members from sliding sideways off their respective axles.

Referring to FIG. 2 and FIG. 3, first and second springs 24 and 25 are in compression and push against a first slide 29 and a second slide 30, respectively. First and second slides 29 and 30 transmit the respective spring forces via a pair of first operating cables 31 and a pair of second operating cables 32 to a pair of first cotter pins 33 and a pair of second cotter pins 34, respectively. First and second operating cables 31 and 32 are lengths of high strength wire rope which are capable of sustaining repeated tension, bending and flexural loads but which are short enough to support the compressive loads of first and second springs 24 and 25 without buckling. First and second pair of cotter pins 33 and 34 are loosely attached to first and second pairs of opposing cam members 11 and 12, and 13 and 14, respectively. The ends of first and second pairs of operating cables 31 and 32 are joined to first and second slides 29 and 30, and first and second pairs of cotter pins 33 and 34 by either swaging or brazing. Movements of first and second slides 29 and 30 are guided by cable 19 which passes with loose fit through a first hole 35 and a second hole 36, respectively. Similarly, movements of first and second springs 24 and 25 are guided by cable 19 which runs along the inside of first and second springs 24 and 25 with loose fit. Because first slide 29 and first spring 24 are free to move independently of second slide 30 and second spring 25, and the reverse, the first pair of opposing cam members 11 and 12 are free to move independently of the second pair of opposing cam members 13 and 14, and the reverse. Such independent action enables all of the cam members to make contact with non-parallel crack walls.

Referring, again, to FIG. 2 and FIG. 4, one of the pair of first operating cables 31 is extended past first slide 29 and passes with loose fit through a first hole 37 in operating bar 38 and terminates with a first swaged stop sleeve 39. Similarly, one of the pair of second operating cables 32 is extended past second slide 30 and passes with loose fit through a second hole 40 in operating bar 38 and terminates with a second swaged stop sleeve 41. Operating bar 38 is located within finger reach of the climbing rope attachment point. By pulling operating bar 38 toward the climbing rope attachment point, first and second slides 29 and 30 are forced backward thereby additionally compressing first and second springs 24 and 25. This action pulls back first and second pair of operating cables 31 and 32 thereby simultaneously moving first and second pair of cam members 11 and 12, and 13 and 14 to their retracted positions.

Although the preferred embodiment incorporates operating bar 38 in order to facilitate the climber's ability to grasp and pull with a finger, the operating bar can be eliminated by joining the ends of first and second operating cables 31 and 32 so that a loop is formed within finger reach of the climbing rope attachment point.

Figure 5:
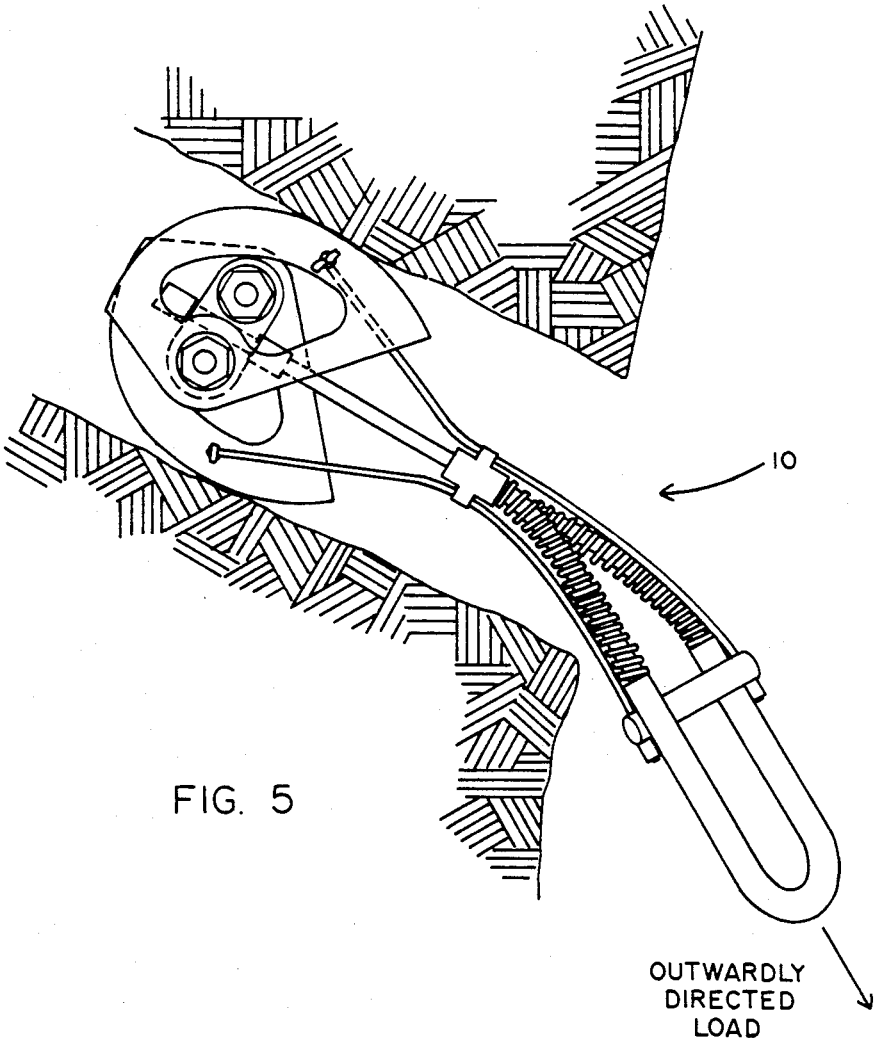
FIG. 5 is another front elevational view showing the rope attachment member both twisted and bend due to a sidewardly directed load.

Referring to FIG. 5, the improved climbing aid 10, when inserted in and firmly anchored to a crack, may be twisted and bent due to a sidewardly directed load. The flexibility of cable 19 enables improved climbing aid 10 to remain reliably and securely anchored without danger of failure in spite of the sidewardly directed load.

Figure 6:
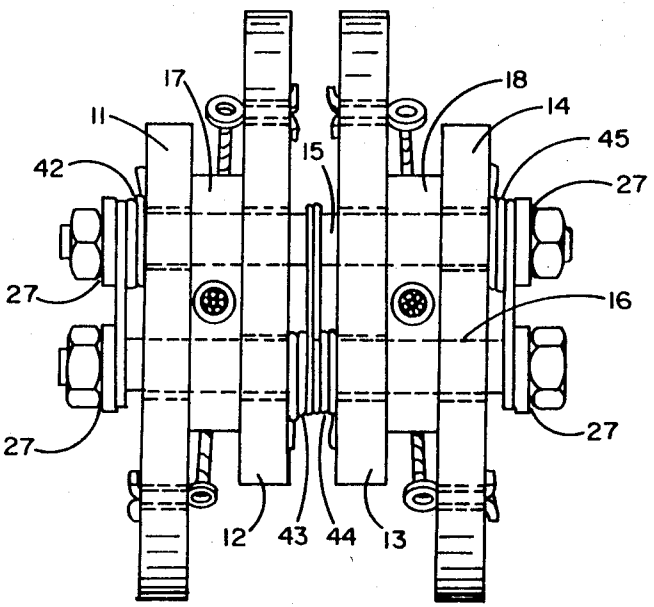
FIG. 6 is another top view showing an alternate spring configuration.

Referring to FIG. 6, an alternate spring configuration is shown which includes a first set of torsion springs 42 and 43 independently joined, one each, to first set of cam members 11 and 12, respectively, and a second set of torsion springs 44 and 45 independently joined, one each, to second set of cam members 13 and 14, respectively. Torsion springs 42 and 45 are mounted on first axle 15 adjacent to cam members 11 and 14, respectively. Torsion springs 43 and 44 are mounted on second axle 16 adjacent to cam members 12 and 13, respectively. Torsion spring 42 forces cam member 11 to independently move toward its fully expanded position. Similarly, torsion springs 43, 44 and 45 force respective cam members 12, 13 and 14 to independently move toward their fully expanded positions.

The alternate embodiment of FIG. 6 does not require first and second compression springs 24 and 25, and first and second slides 29 and 30, respectively. First and second operating cables 31 and 32 are joined directly to operating bar 38. Also, spacer 28 can be eliminated, the space being filled by torsion springs 43 and 44.

I claim:

1. A climbing aid comprising:
opposing cam members,
two axles having separate, parallel centerlines on which said cam members pivot with crossed radii,
axle joining member,
rope attachment member,
forcing means for expanding said cam members, and
operating means for retracting said cam members.

2. A climbing aid according to claim 1 wherein said axle joining member is situated between said opposing cam members.

3. A climbing aid according to claim 1 wherein said rope attachment member is a looped wire rope.

4. A climbing aid according to claim 3 wherein said looped wire rope is formed U-shaped with a sheath of rigid tubing at the curve of the "U".

5. A climbing aid according to claim 3 wherein said looped wire rope is swivelably attached to said axle joining member.

6. A climbing aid according to claim 1 wherein said cam members have a central cut-out shaped to provide clearance for limited angular movement with respect to said parallel axles.

7. A climbing aid according to claim 1 wherein said forcing means comprises compression springs mounted on and guided by said rope attachment member.

8. A climbing aid according to claim 1 wherein said forcing means comprises torsion springs mounted on said parallel axles.

9. A climbing aid according to claim 1 wherein said operating means is a rod attached with flexible connecting means to each cam member.

10. A climbing aid according to claim 9 wherein said flexible connecting means is a wire rope.

11. A climbing aid comprising:

two sets of opposing cam members, two parallel axles on which said cam members pivot with crossed radii, a central cut-out in each cam member shaped to provide clearance for limited angular movement with respect to said parallel axles, two axle joining members each situated between a set of opposing cam members, U-shaped loop of wire rope swivelably attached to both axle joining members, torsion springs mounted on said axles which independently expand each cam member, and an operating bar connected with wire rope to each cam member which, when pulled, retracts said cam members.

* * * * *